US010421296B2

(12) United States Patent
Ikegami et al.

(10) Patent No.: US 10,421,296 B2
(45) Date of Patent: Sep. 24, 2019

(54) IMAGE FORMING APPARATUS, CONTROL METHOD THEREOF, AND EXAMINATION METHOD

(71) Applicant: CANON KABUSHIKI KAISHA, Tokyo (JP)

(72) Inventors: Shinsuke Ikegami, Tokyo (JP); Takuya Tsunemi, Tokyo (JP); Satoshi Tada, Kawasaki (JP); Kenji Kubozono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/901,187

(22) Filed: Feb. 21, 2018

(65) Prior Publication Data

US 2018/0264854 A1 Sep. 20, 2018

(30) Foreign Application Priority Data

Mar. 14, 2017 (JP) ..... 2017-049062

(51) Int. Cl.

| | |
|---|---|
| ***B41J 2/21*** | (2006.01) |
| ***B41J 11/00*** | (2006.01) |
| ***B41J 11/46*** | (2006.01) |
| ***B41J 2/045*** | (2006.01) |

(52) U.S. Cl.

CPC ..... *B41J 11/0095* (2013.01); *B41J 2/04558* (2013.01); *B41J 2/21* (2013.01); *B41J 11/46* (2013.01)

(58) Field of Classification Search

CPC ..... B41J 11/0095; B41J 2/04558; B41J 11/46

See application file for complete search history.

(56) References Cited

U.S. PATENT DOCUMENTS

2017/0028749 A1* 2/2017 Kanno ..... B41J 11/0095

FOREIGN PATENT DOCUMENTS

JP 5474173 B2 4/2014

* cited by examiner

*Primary Examiner* — Julian D Huffman
(74) *Attorney, Agent, or Firm* — Venable LLP

(57) ABSTRACT

An image forming apparatus comprises a detection unit that detects that a recording material is conveyed to a predetermined position on a conveyance path; a forming unit that forms an examination pattern at a defined position of the recording material; a reading unit that reads an image on the conveyance path when the recording material is being conveyed; a memory that saves read image data during a predetermined period defined based on a detection timing of the detection unit; a specifying unit that specifies an edge of the recording material by detecting an area corresponding to the conveyance path in the image data saved in the memory, and specifies an examination pattern area corresponding to the examination pattern based on the specified edge and the defined position; and an examining unit that examines the examination pattern area.

18 Claims, 10 Drawing Sheets

IMAGE FORMING APPARATUS, CONTROL METHOD THEREOF, AND EXAMINATION METHOD

BACKGROUND OF THE INVENTION

Field of the Invention

The present invention relates to an image forming apparatus, a control method thereof, and an examination method.

Description of the Related Art

Conventionally, an image forming apparatus uses an arrangement for performing image formation on a sheet while conveying the sheet. At this time, to form the image at an appropriate position of the sheet, it is necessary to detect the difference between the position of the sheet that is being conveyed and the position for performing image formation, and correct an error generated by the conveyance.

There is conventionally a method of specifying a shift by forming an examination pattern on an examination target and detecting the examination pattern. For example, Japanese Patent No. 5474173 discloses a technique of examining a pattern by forming a predetermined image in an examination target area and acquiring the predetermined image while maintaining a moving speed.

In the image forming apparatus, the longer the sheet for forming an image, the larger the conveyance error caused by a variation in the conveyance speed or a slip of the sheet. As a result, to detect the position of the examination pattern, if a sufficiently large marginal area is not provided before the examination pattern, a mark used to detect the image or the examination pattern may erroneously be detected as the examination pattern. On the other hand, when a sufficiently large marginal area is provided, a large area of a sheet is consumed for an application purpose other than image recording.

SUMMARY OF THE INVENTION

The present invention enables pattern detection while reducing a marginal area.

According to one aspect of the present invention, there is provided an image forming apparatus comprising: a detection unit configured to detect that a recording material is conveyed to a predetermined position on a conveyance path; a forming unit configured to form an examination pattern at a defined position of the recording material; a reading unit configured to read an image on the conveyance path when the recording material is being conveyed; a memory configured to save image data read by the reading unit during a predetermined period defined based on a detection timing of the detection unit; a specifying unit configured to specify an edge of the recording material by detecting an area corresponding to the conveyance path in the image data saved in the memory, and specify an examination pattern area corresponding to the examination pattern based on the specified edge and the defined position; and an examining unit configured to examine the examination pattern area.

According to another aspect of the present invention, there is provided a control method of an image forming apparatus including: a detection unit configured to detect that a recording material is conveyed to a predetermined position on a conveyance path; a forming unit configured to form an examination pattern at a defined position of the recording material; a reading unit configured to read an image on the conveyance path when the recording material is being conveyed; and a memory configured to save image data read by the reading unit, the method comprising: saving the image data read by the reading unit in the memory during a predetermined period defined based on a detection timing of the detection unit; specifying an edge of the recording material by detecting an area corresponding to the conveyance path in the image data saved in the memory; specifying an examination pattern area corresponding to the examination pattern based on the specified edge and the defined position; and examining the examination pattern area.

According to another aspect of the present invention, there is provided an examination method comprising: acquiring image data obtained by reading an image on a conveyance path when a recording material on which an examination pattern is formed at a defined position is conveyed during a predetermined period defined based on a timing at which the recording material is conveyed to a predetermined position on the conveyance path; and examining an examination pattern area corresponding to the examination pattern based on the obtained image data, wherein as for the examination pattern, an edge of the recording material is specified by detecting an area corresponding to the conveyance path in the image data, and the examination pattern area is specified based on the specified edge of the recording material and the defined position.

According to the present invention, it is possible to reduce a marginal area of a sheet when forming an examination pattern on the conveyed sheet.

Further features of the present invention will become apparent from the following description of exemplary embodiments (with reference to the attached drawings).

DESCRIPTION OF THE EMBODIMENTS

An embodiment of the present invention will now be described with reference to the accompanying drawings. Note that an image forming apparatus including an inkjet printhead will be exemplified in the following description. However, the present invention is not limited to this.

First Embodiment

[System Arrangement]

Figure 1:
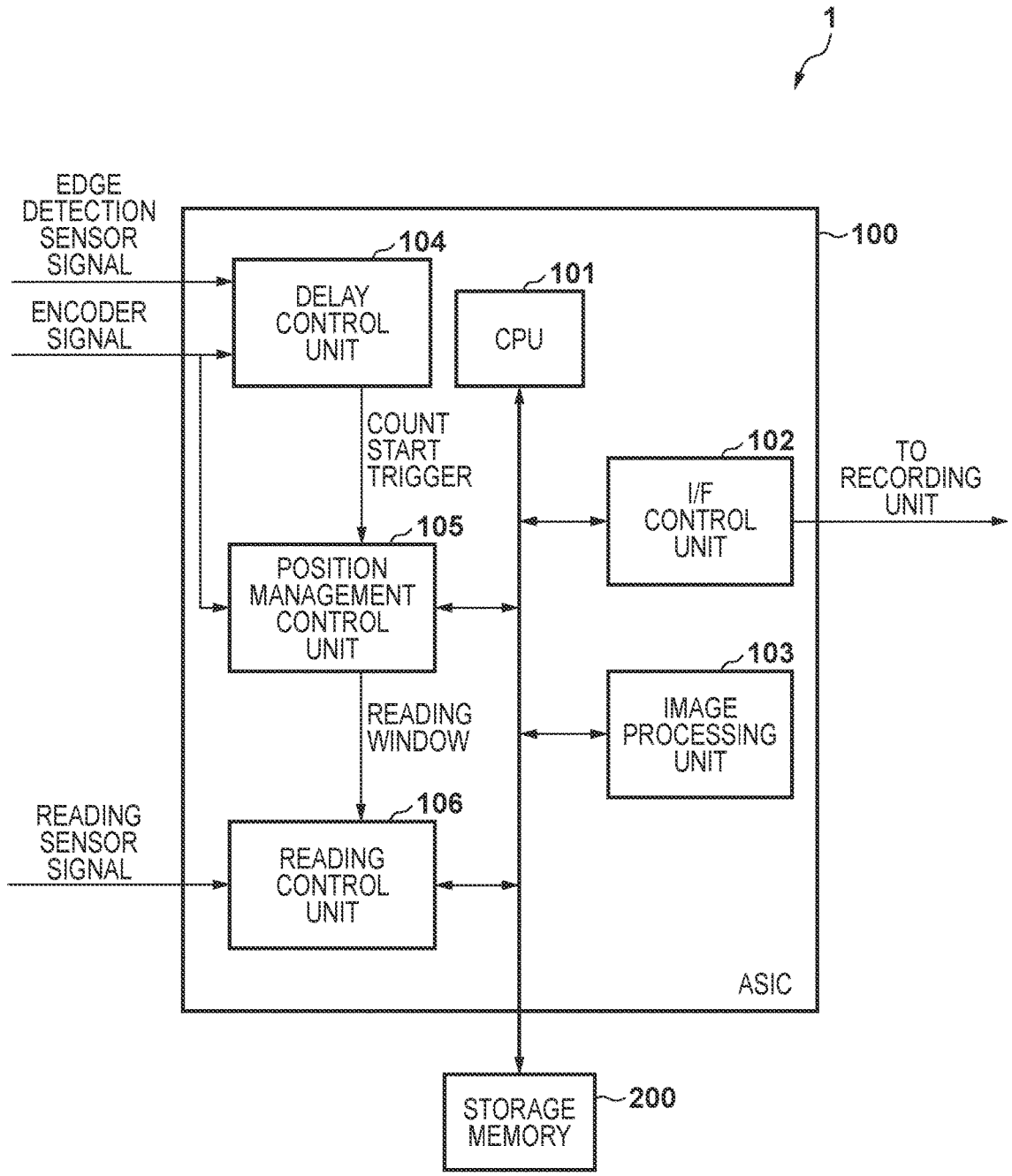
FIG. 1 is a block diagram showing an example of the arrangement of hardware.

FIG. 1 shows an example of the hardware arrangement of an image forming apparatus 1 according to this embodiment. The image forming apparatus 1 includes an ASIC (Application Specific Integrated Circuit) 100 that controls the entire image forming apparatus 1, a storage memory 200 serving as a storage area, a recording unit 300 that performs an image forming operation by applying ink, and a conveyance unit (not shown) that conveys a recording material (to be referred to as a sheet hereinafter) such as paper and controls the conveyance.

The ASIC 100 includes a CPU 101, an I/F control unit 102, an image processing unit 103, a delay control unit 104, a position management control unit 105, and a reading control unit 106. The CPU 101 controls each portion of the ASIC 100. Note that although not illustrated in FIG. 1, the CPU 101 receives a job to instruct image formation from an external apparatus such as a PC, and controls the image forming operation based on the job. The I/F control unit 102 is an interface to the recording unit 300, and sends various kinds of signals to control the recording unit 300. The image processing unit 103 performs various kinds of image processing for image data used to perform the image forming operation. Here, the image processing unit 103 processes an examination pattern in addition to image data from the user, which is designated by a job. The delay control unit 104 receives a detection signal detected by an edge detection sensor 320 arranged on the conveyance path of the sheet in the image forming apparatus 1, and an encoder signal, and performs processing for delay of conveyance. In addition, the encoder signal is input from the conveyance unit and used to detect the conveyance state (timing) of the sheet.

The delay control unit 104 outputs a count start trigger as a control signal to the position management control unit 105. Details of the count start trigger will be described later. The position management control unit 105 receives the encoder signal and the count start trigger and controls the reading position of the sheet on the conveyance path. In addition, the position management control unit 105 outputs a signal concerning the reading position to the reading control unit 106 as a reading Window. The reading control unit 106 receives a signal read by a reading sensor 310 and the reading Window, and controls an operation of saving the image read by the reading sensor 310 in the storage memory 200.

The storage memory 200 is formed from a ROM, a RAM, an HDD, and the like, and stores image data, a program to be executed by the CPU 101, and the like.

Figure 2:
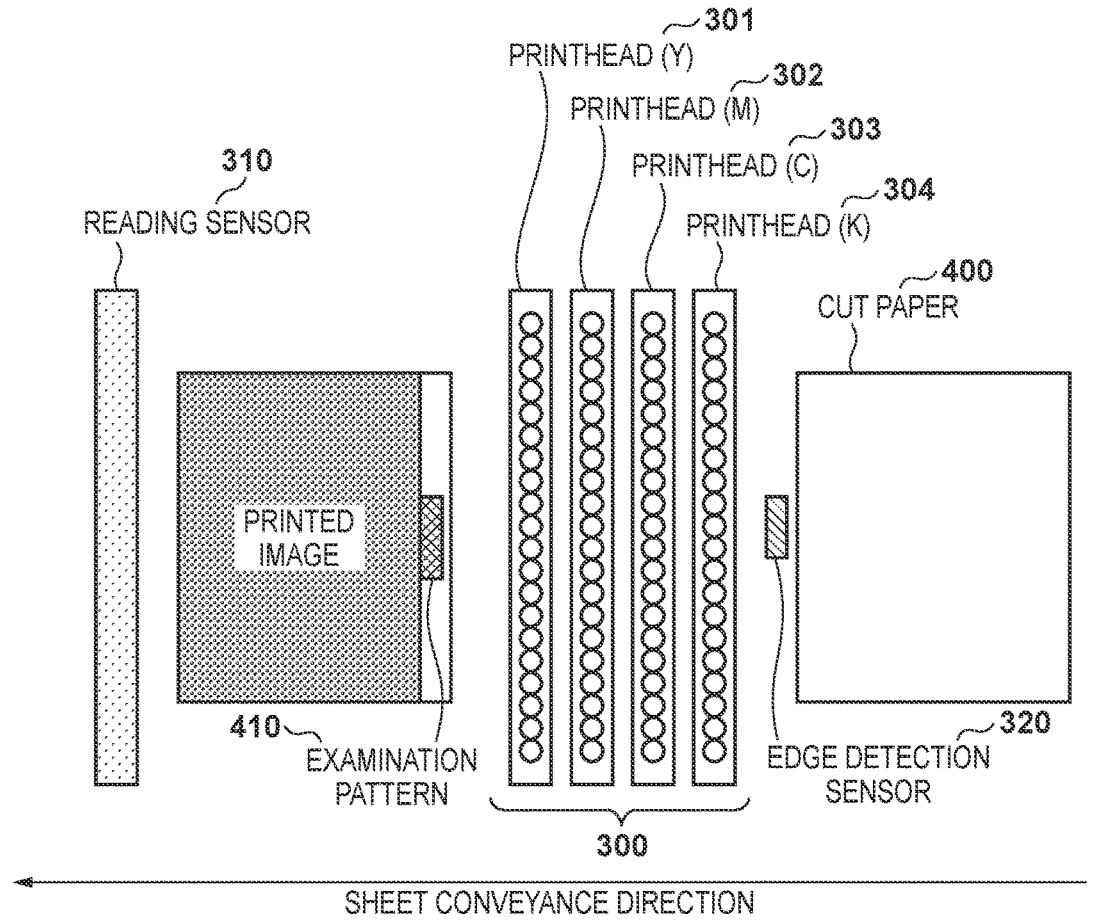
FIG. 2 is a view for explaining conveyance of a sheet.

FIG. 2 is a view for explaining conveyance of a sheet 400 in the image forming apparatus 1 according to this embodiment. Referring to FIG. 2, the edge detection sensor 320, the recording unit 300, and the reading sensor 310 are arranged on the conveyance path from the upstream side (the right side in FIG. 2). In this embodiment, a description will be made assuming that the sheet 400 is not continuous paper but cut paper. FIG. 2 shows a state before and after an image and an examination pattern (to be described later) are recorded on the sheet 400.

The recording unit 300 is formed from a plurality of printheads corresponding to a plurality of colors. Here, the recording unit 300 is assumed to be formed from full-line printheads 301 to 304 of four colors, that is, yellow (Y), magenta (M), cyan (C), and black (K). The printheads 301 to 304 are arranged in parallel along the conveyance direction. In each of the printheads 301 to 304, a plurality of nozzles each including a recording element configured to discharge ink as a recording material are arranged in a direction crossing the conveyance direction.

On the sheet 400, an examination pattern 410 is formed in addition to an image (to be referred to as a user image hereinafter) from the user, which is instructed by a job. On the sheet 400, an area (to be referred to as an image area hereinafter) in which the user image is formed and an area (to be referred to as an examination pattern area hereinafter) in which the examination pattern 410 is formed are defined in advance. Here, the examination pattern 410 is formed on the upstream side of the image area in the conveyance direction. After the user image is formed in the image area, the examination pattern is formed at a position adjacent to the image area. The edge detection sensor 320 is a sensor configured to detect the edge of the sheet 400 conveyed on the conveyance path. Upon detecting the edge of the sheet 400, the edge detection sensor 320 outputs a signal to the delay control unit 104 of the ASIC 100. The edge here indicates the leading edge of the sheet (cut paper). The reading sensor 310 reads the image formed on the sheet 400 conveyed on the conveyance path. Here, a full-line image reading sensor is used. However, the reading method and the like are not particularly limited. The read image is output to the reading control unit 106.

Figure 3:
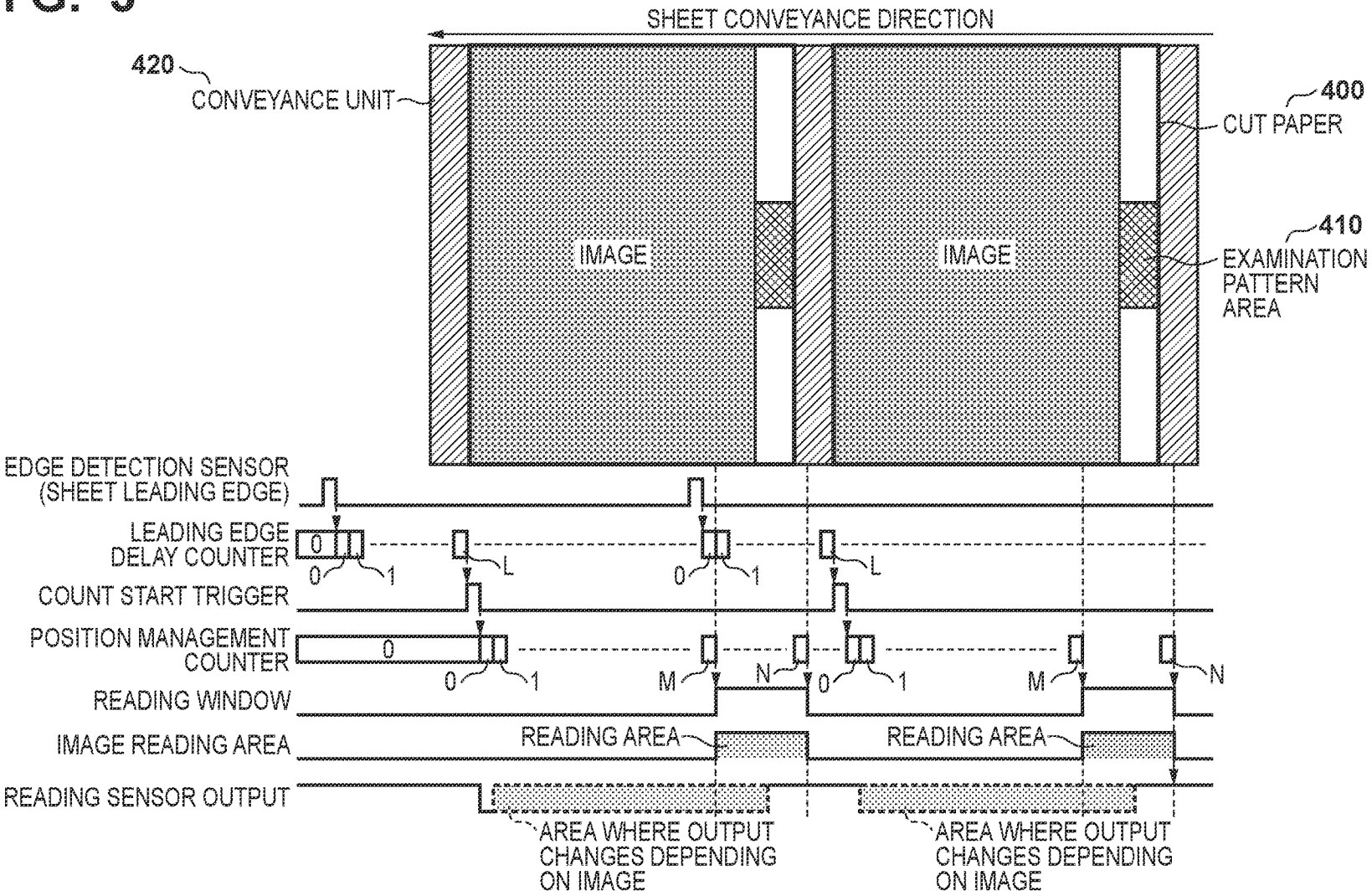
FIG. 3 is a view for explaining reading of a sheet.

FIG. 3 is a view for explaining reading of the sheet 400 on which image formation is done by the recording unit 300 in this embodiment. Assume here that a plurality of sheets 400 (cut paper) are conveyed at a predetermined speed on the conveyance path. Also assume that the color of the background of a conveyance unit 420 that conveys the sheet 400 is specified in advance, and the information is held in the storage memory 200 or the like. Additionally, in this embodiment, a description will be made assuming that the edge detection sensor 320 detects, as an edge, the leading edge of the sheet 400.

First, when the edge detection sensor 320 detects the leading edge of the sheet 400, the delay control unit 104 starts counting of a leading edge delay counter. When the value of the leading edge delay counter reaches a predetermined value L (>0), the delay control unit 104 outputs a count start trigger to the position management control unit 105. That is, the count start trigger is output when the value of the counter becomes L after the detection timing at which the edge detection sensor 320 detects the leading edge of the sheet 400. The value L here is set in accordance with the conveyance speed of the sheet 400 and the distance between the edge detection sensor 320 and the reading sensor 310 on the conveyance path. When the edge detection sensor 320 detects the leading edge of the subsequent sheet 400, the delay control unit 104 initializes the value of the leading edge delay counter and starts counting again.

Upon receiving the count start trigger output from the delay control unit 104, the position management control unit 105 starts counting of a position management counter. When the value of the position management counter reaches a predetermined value M (>0), the position management control unit 105 notifies the reading control unit 106 of a control signal to open the reading Window. In addition, when the value of the position management counter reaches a predetermined value N (>M), the position management control unit 105 notifies a control signal to close the reading Window. After that, upon receiving the count start trigger output from the delay control unit 104 again, the position management control unit 105 initializes the value of the position management counter and starts counting again. The relationship between the value M and the value N for the position management counter is defined in accordance with the size of the examination pattern area in the conveyance direction or the conveyance speed.

To the reading control unit 106, a signal (image information) read by the reading sensor 310 is sequentially input. Here, upon receiving the control signal to open the first reading Window, the reading control unit 106 starts saving the image information input from the reading sensor 310 in a predetermined area of the storage memory 200. After that, upon receiving the control signal to close the reading Window, the reading control unit 106 ends the saving of the image information input from the reading sensor 310 in the storage memory 200. That is, the saving operation of the image information read from the conveyed sheet 400 is controlled in accordance with the control signal of the reading Window. The range to be saved here is defined as a reading area. In this embodiment, the reading area is formed so as to include not only the range of the examination pattern area but also portions of the image area before and after the examination pattern area in the conveyance direction and the portion of the conveyance unit as the background. Hence, the value M and the value N are defined to form the reading area. Note that the values L, M, and N can be held in, for example, the storage memory 200.

Figure 4:
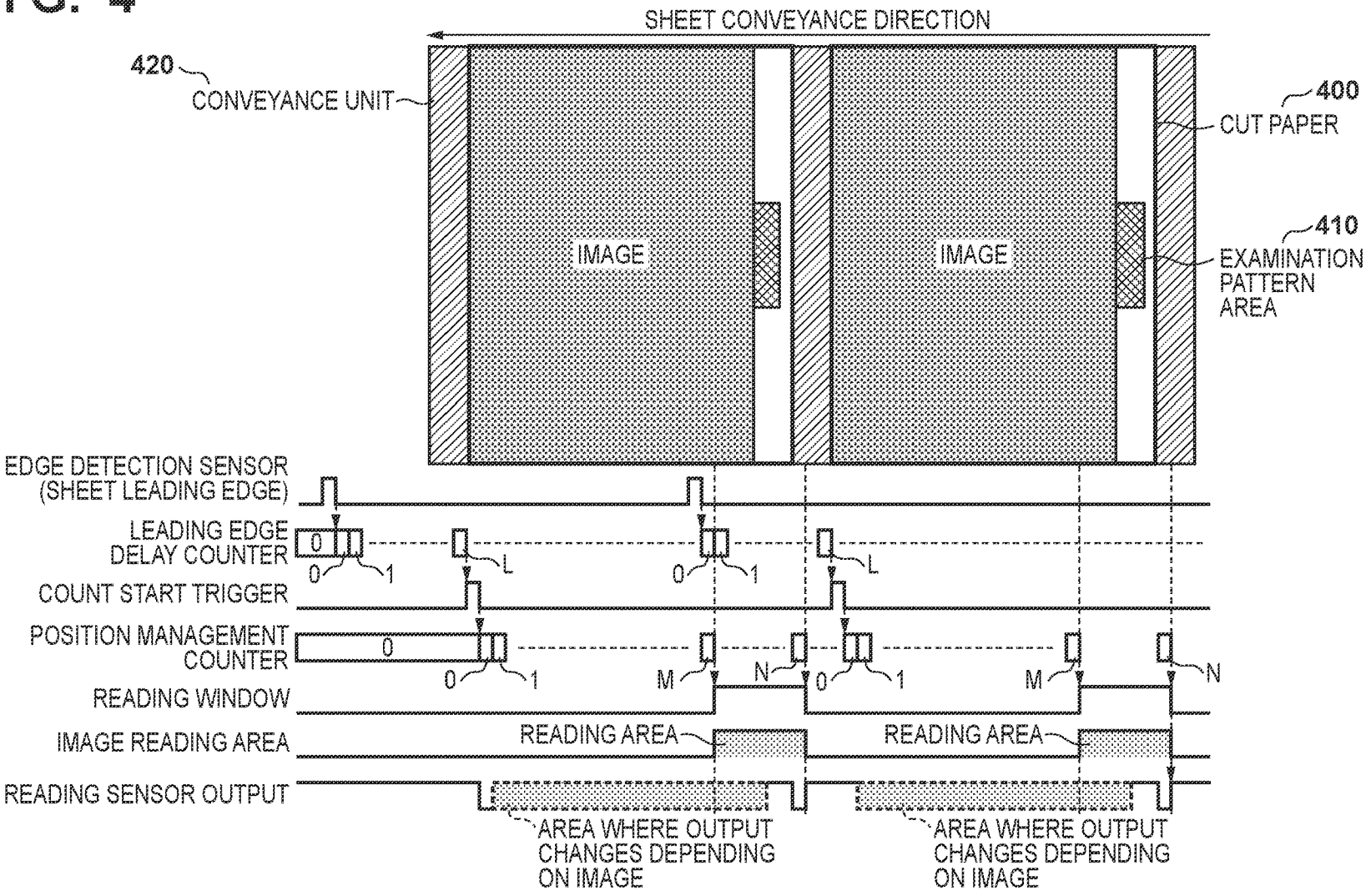
FIG. 4 is a view for explaining reading of a sheet.

FIG. 4 is another view for explaining reading of the sheet 400 on which image formation is done by the recording unit 300 according to this embodiment. The basic arrangement is the same as that described with reference to FIG. 3. However, the examination pattern area is different from that shown in FIG. 3. FIG. 4 shows an example in which a paper white area is further formed as a margin after the examination pattern 410 in the conveyance direction on the sheet 400. At this time, information about the width of the paper white area in the conveyance direction is stored in the storage memory 200 in advance. Note that in this embodiment, the position of the examination pattern falls within a predetermined range at the center in a direction crossing the conveyance direction. However, the present invention is not limited to this arrangement. For example, the examination pattern may be formed on an edge side.

[Processing Sequence]

(Image Reading Operation)

Figure 5:
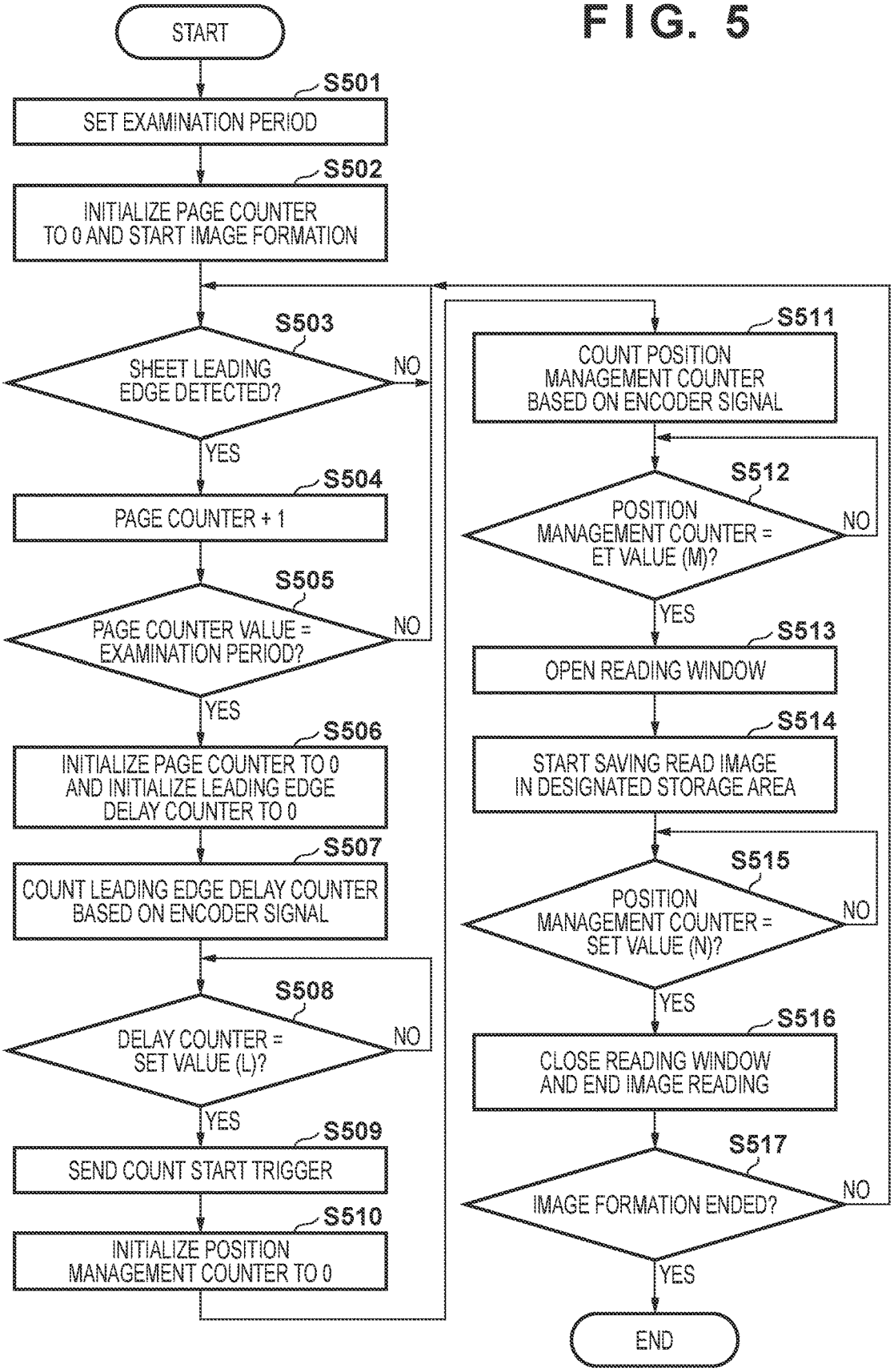
FIG. 5 is a flowchart of an image reading operation.

FIG. 5 is a flowchart of an image reading operation according to this embodiment.

In step S501, the CPU 101 receives settings concerning the period of the examination pattern. The period here indicates at what interval the reading operation is to be performed for a plurality of sheets conveyed on the conveyance path. The interval to perform examination is thus set using the number of sheets to be conveyed as the unit. The setting concerning the period here may be received from the user via a UI (not shown) displayed on a display unit (not shown) provided on the image forming apparatus 1 or may be defined in advance. The shorter the period is, the more the accuracy due to shift correction to be described later improves. However, the load of image formation or consumption of ink or the like increases.

In step S502, the CPU 101 initializes a page counter to 0 and instructs, via the I/F control unit 102, the recording unit 300 to start image formation. As the image to be formed here, image data held in the storage memory 200 and processed by the image processing unit 103 is used. In addition, the sheet 400 is conveyed on the conveyance path in accordance with the start of the image forming operation.

In step S503, the CPU 101 determines whether the edge detection sensor 320 detected the leading edge of the conveyed sheet 400. Upon determining that the leading edge is detected (YES in step S503), the process advances to step S504. Upon determining that the leading edge is not detected (NO in step S503), the process waits until the leading edge is detected.

In step S504, the CPU 101 increments the value of the page counter by one.

In step S505, the CPU 101 determines whether the value of the page counter matches the value of the period received in step S501. A case of determining that the value matches the period is a timing to read the examination pattern. If the values match (YES in step S505), the process advances to step S506. If the values do not match (NO in step S505), the process returns to step S503.

In step S506, the CPU 101 initializes the page counter to 0. In addition, the CPU 101 causes the delay control unit 104 to initialize the leading edge delay counter to 0.

In step S507, the delay control unit 104 counts the leading edge delay counter based on the encoder signal.

In step S508, the delay control unit 104 determines whether the value of the leading edge delay counter has reached the value L. Upon determining that the value of the leading edge delay counter has not reached the value L (NO in step S508), the process returns to step S507 to continue counting of the leading edge delay counter. Upon determining that the value of the leading edge delay counter has reached the value L (YES in step S508), the process advances to step S509.

In step S509, the delay control unit 104 outputs a count start trigger to the position management control unit 105.

In step S510, when the count start trigger from the delay control unit 104 is received, the position management control unit 105 initializes the position management counter to 0.

In step S511, the position management control unit 105 counts the position management counter based on the encoder signal.

In step S512, the position management control unit 105 determines whether the value of the position management counter has reached the value M. Upon determining that the value of the position management counter has not reached the value M (NO in step S512), the process returns to step S511 to continue counting of the position management counter. Upon determining that the value of the position management counter has not reached the value M (YES in step S512), the process advances to step S513.

In step S513, the position management control unit 105 sends the control signal to the reading control unit 106 so as to open the reading Window.

In step S514, the reading control unit 106 starts saving image information read by the reading sensor 310 in a predetermined area of the storage memory 200 based on the control signal from the position management control unit 105.

In step S515, the position management control unit 105 determines whether the value of the position management counter has reached the value N. Upon determining that the value of the position management counter has not reached the value N (NO in step S515), the position management control unit 105 continues counting of the position management counter. Upon determining that the value of the position management counter has reached the value N (YES in step S515), the process advances to step S516.

In step S516, the position management control unit 105 sends the control signal to the reading control unit 106 so as to close the reading Window. Accordingly, the reading control unit 106 ends saving of the image information read by the reading sensor 310 in the storage memory 200.

In step S517, the CPU 101 determines whether the image forming operation has ended. Upon determining that the image forming operation has not ended (NO in step S517), the process returns to step S503. Upon determining that the image forming operation has ended (YES in step S517), the processing sequence ends.

In the above-described example, the saving operation of the image information is controlled based on the control signal of the reading Window output from the position management control unit 105. In addition, the reading operation of the reading sensor 310 may also be controlled. Control may be performed such that the reading operation of the reading sensor 310 in an area other than the reading area is inhibited when the reading control unit 106 is not performing the saving operation of the image information in the storage memory 200.

Figure 6A:
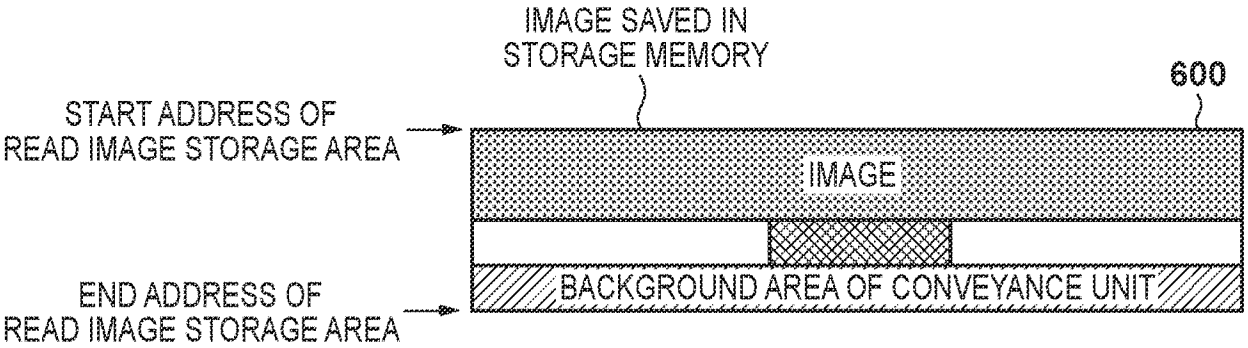
FIGS. 6A and 6B are views for explaining the outline of read data (image)
Figure 6B:
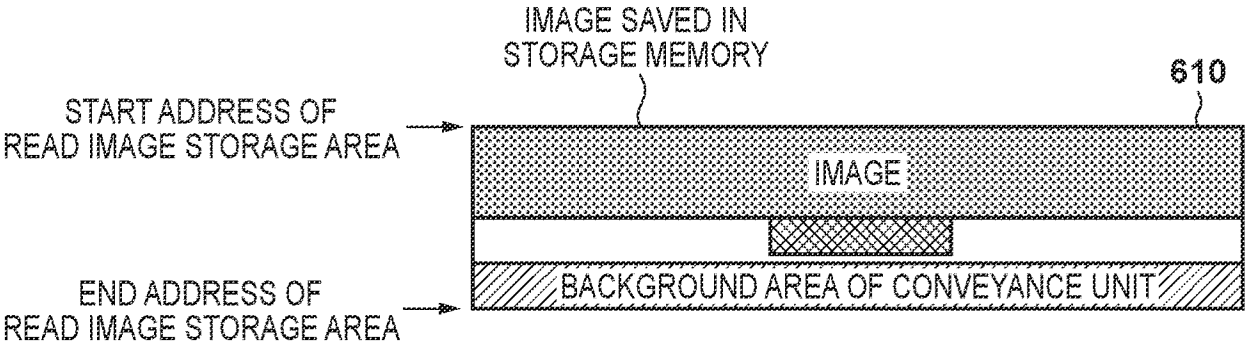

FIGS. 6A and 6B are views showing the outline of image information saved in a predetermined area of the storage memory 200 by the reading control unit 106. Each of FIGS. 6A and 6B shows image data stored in the predetermined area of the storage memory 200 during a period controlled as a reading area shown in FIG. 3 or 4. FIG. 6A shows an example in which image information is saved in the arrangement shown in FIG. 3. Additionally, FIG. 6B shows an example in which image information is saved in the arrangement shown in FIG. 4. Referring to FIG. 6A, image information 600 is formed from an image area, an examination pattern area, and the background area of the conveyance unit. Referring to FIG. 6B, image information 610 is formed from an image area, an examination pattern area, and the background area of the conveyance unit, and a paper white area where neither an image nor an examination pattern is formed is located between the examination pattern area and the background area.

Figure 7A:
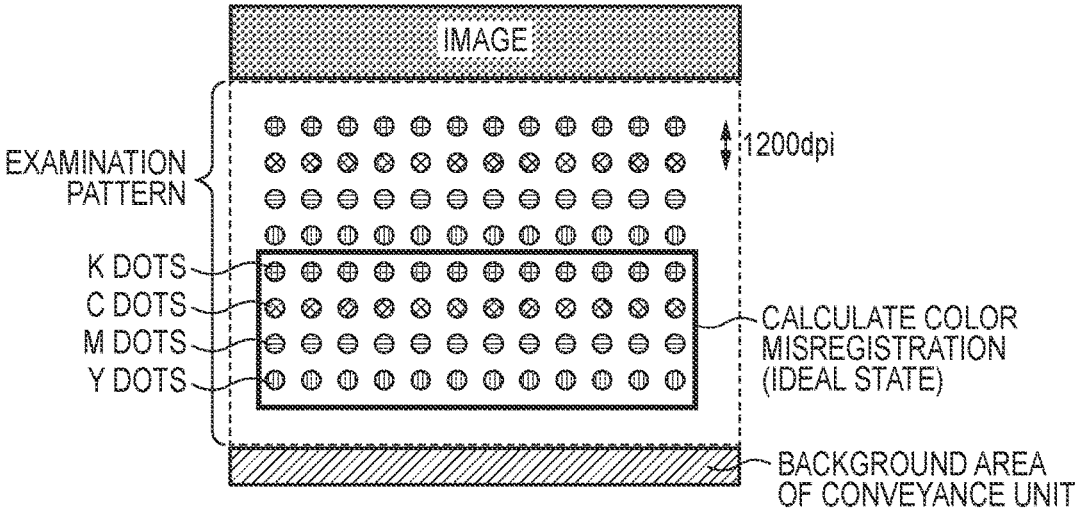
FIGS. 7A, 7B, 7C, and 7D are views for explaining details of read data (image)
Figure 7B:
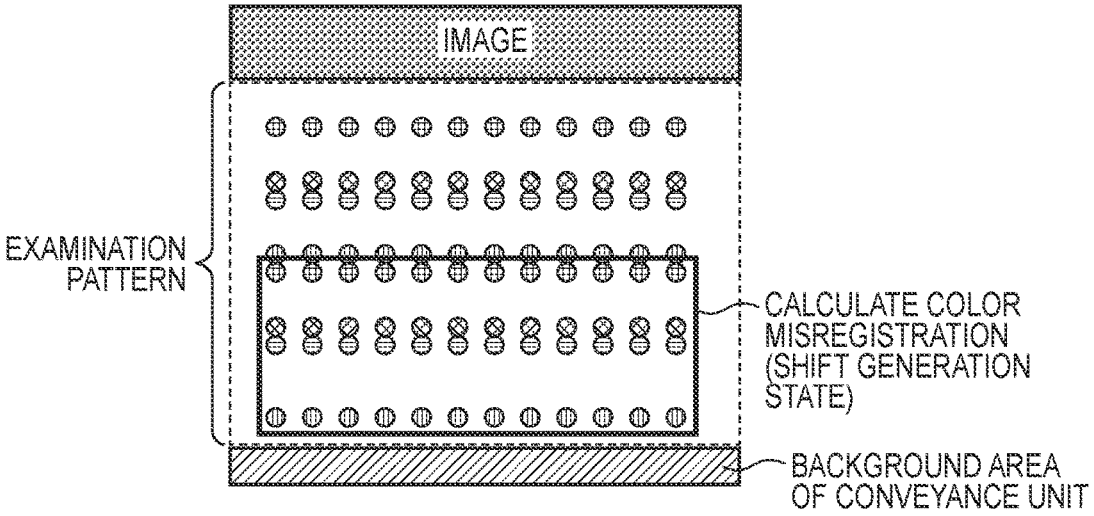
Figure 7C:
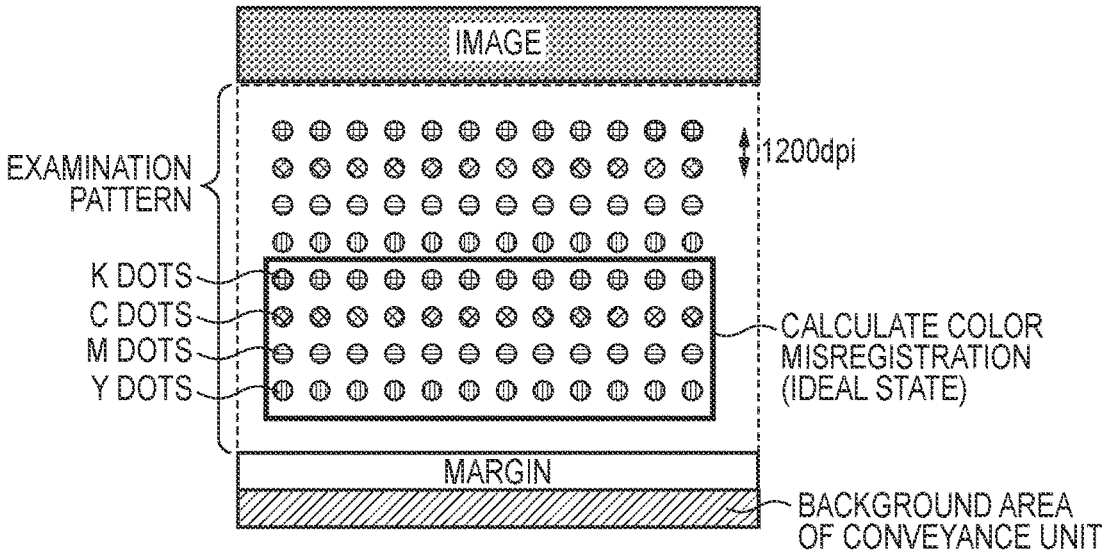
Figure 7D:
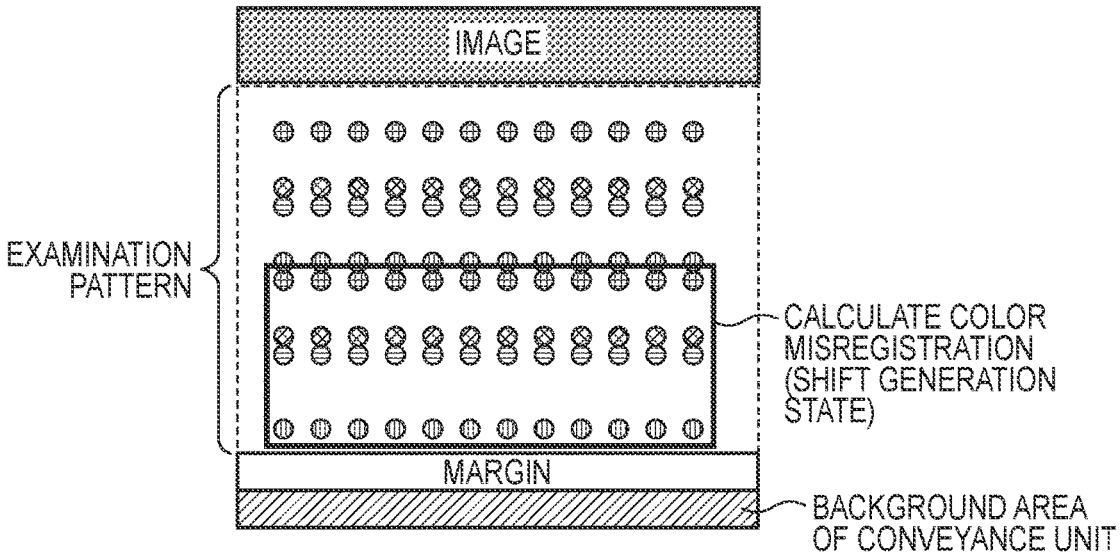

FIGS. 7A to 7D are views showing details of image information saved in a predetermined area of the storage memory 200 by the reading control unit 106. FIGS. 7A and 7B show examples in which image information is saved in the arrangement shown in FIG. 3, and FIGS. 7C and 7D show examples in which image information is saved in the arrangement shown in FIG. 4. Additionally, FIGS. 7A and 7C show cases in which the examination pattern is formed in an ideal state, and FIGS. 7B and 7D show cases in which a shift is generated in forming of the examination pattern. That is, FIGS. 7B and 7D show cases in which a shift is generated between the conveyance of a sheet and the timing of image formation on the sheet. The causes of the shift are a variation in the conveyance speed, a slip of a conveyed sheet, the discharge timing of an ink droplet from a printhead, a landing position shift of an ink droplet, and the like. Here, assume that the shift is generated in the conveyance direction.

(Shift Correction Operation)

Figure 8:
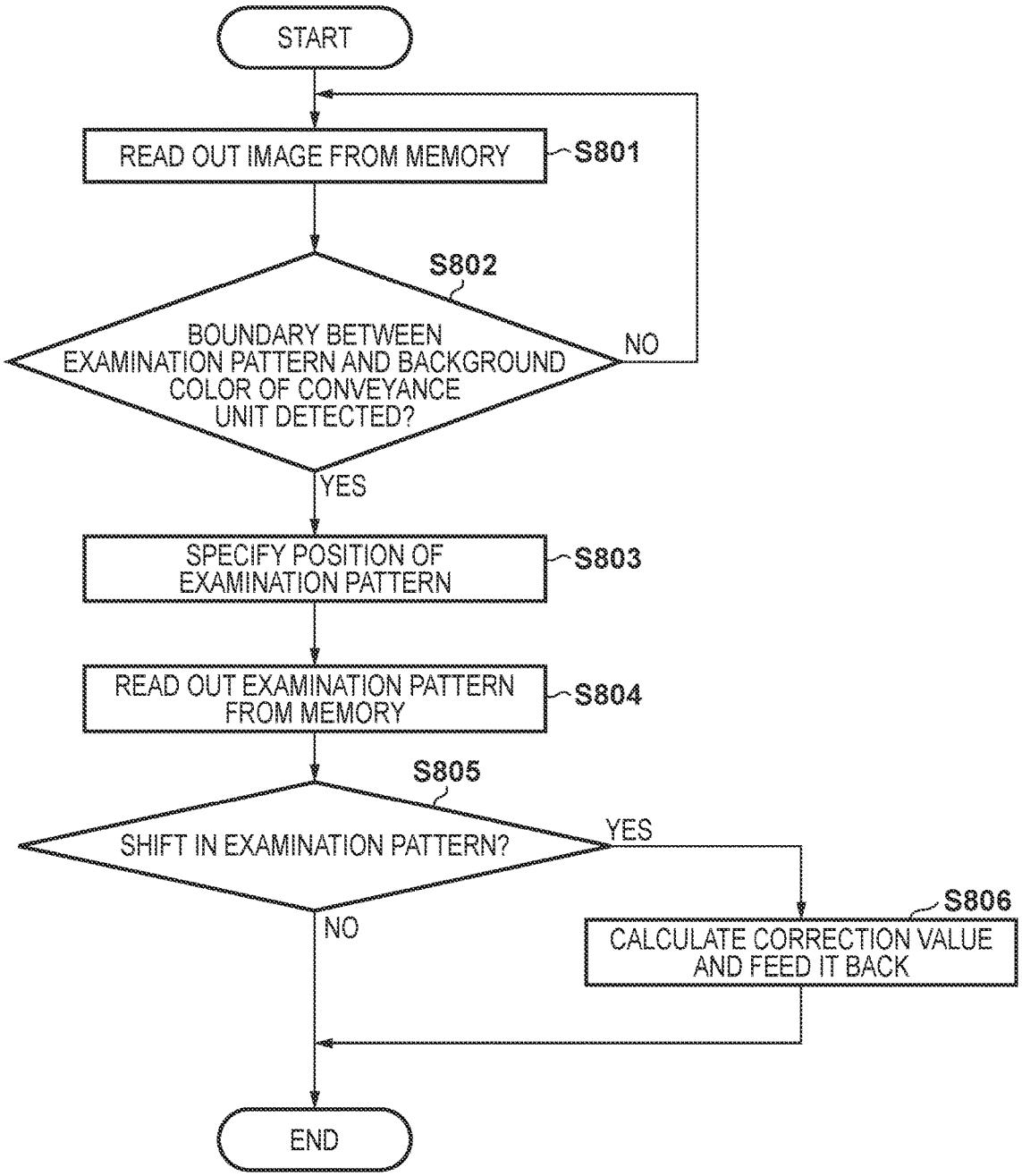
FIG. 8 is a flowchart of an examination operation.

FIG. 8 is a flowchart showing a shift correction operation according to this embodiment. Here, a shift is detected based on image information obtained by the operation described with reference to FIGS. 7A to 7D and corrected.

In step S801, the CPU 101 obtains image information held in a predetermined area of the storage memory 200. The image information obtained here is, for example, the image shown in FIG. 6A or 6B.

In step S802, the CPU 101 analyzes the image information obtained in step S801 and determines whether the boundary between the background area of the conveyance unit and the examination pattern area is detected. More specifically, the CPU 101 first specifies the background area of the image information obtained in step S801. The background area here can be specified from the information of the color of the conveyance unit 420 held in advance. In addition, the boundary between the background area and an area other than the background area is specified. The boundary here corresponds to the trailing edge of the sheet. In the determination here, for example, the image information may be processed by the image processing unit 103, and it may be determined whether a portion serving as a boundary is detected. If the boundary is detected (YES in step S802), the process advances to step S803. If the boundary is not detected (NO in step S802), the process returns to step S801.

In step S803, the CPU 101 specifies the position of the examination pattern for the image read in step S801. The specifying of the position here can be done based on the size of the sheet 400, the size of the user image, and the size of the examination pattern. At this time, if the examination pattern is adjacent to the trailing edge of the sheet 400, as shown in FIG. 3, the area on the downstream side of the boundary to the conveyance unit 420 in the conveyance direction is the examination pattern area. In addition, if a marginal area is provided between the examination pattern and the trailing edge of the sheet 400, as shown in FIG. 4, the area on the downstream side of the boundary to the conveyance unit 420 in the conveyance direction and also on the downstream side of the marginal area is the examination pattern area.

In step S804, the CPU 101 obtains examination pattern data used in image formation from the storage memory 200. The image information of an examination pattern that is formed in a case in which no shift is generated is thus obtained.

In step S805, the CPU 101 compares the examination pattern specified in step S803 with the examination pattern obtained in step S804, and determines whether a shift is generated in the formed examination pattern. For example, if the specified examination pattern is the same as in FIG. 7A, it is determined that a shift is not generated. On the other hand, if the specified examination pattern is that in FIG. 7B, it is determined that a shift is generated. Upon determining that a shift is not generated (NO in step S805), the processing procedure ends. Upon determining that a shift is generated (YES in step S805), the process advances to step S806.

In step S806, the CPU 101 calculates a shift amount based on the result of comparison between the examination pattern specified in step S803 and the examination pattern without a shift, which is obtained in step S804. Then, the CPU 101 calculates a correction value from the shift amount. The correction value here may be a correction value for the conveyance speed, or may be a correction value for an image formation timing such as the discharge timing of an ink droplet from the printhead of each color. The CPU 101 feeds back the calculated correction value to each control unit. After that, the processing procedure ends.

With the above-described arrangement, in this embodiment the amount of a margin needed to generate an examination pattern can be reduced. As a result, the range of an image that can be formed on one sheet can be made large. It is also possible to reduce the size of the memory used to save data obtained by reading the examination pattern.

Other Embodiments

Figure 9:
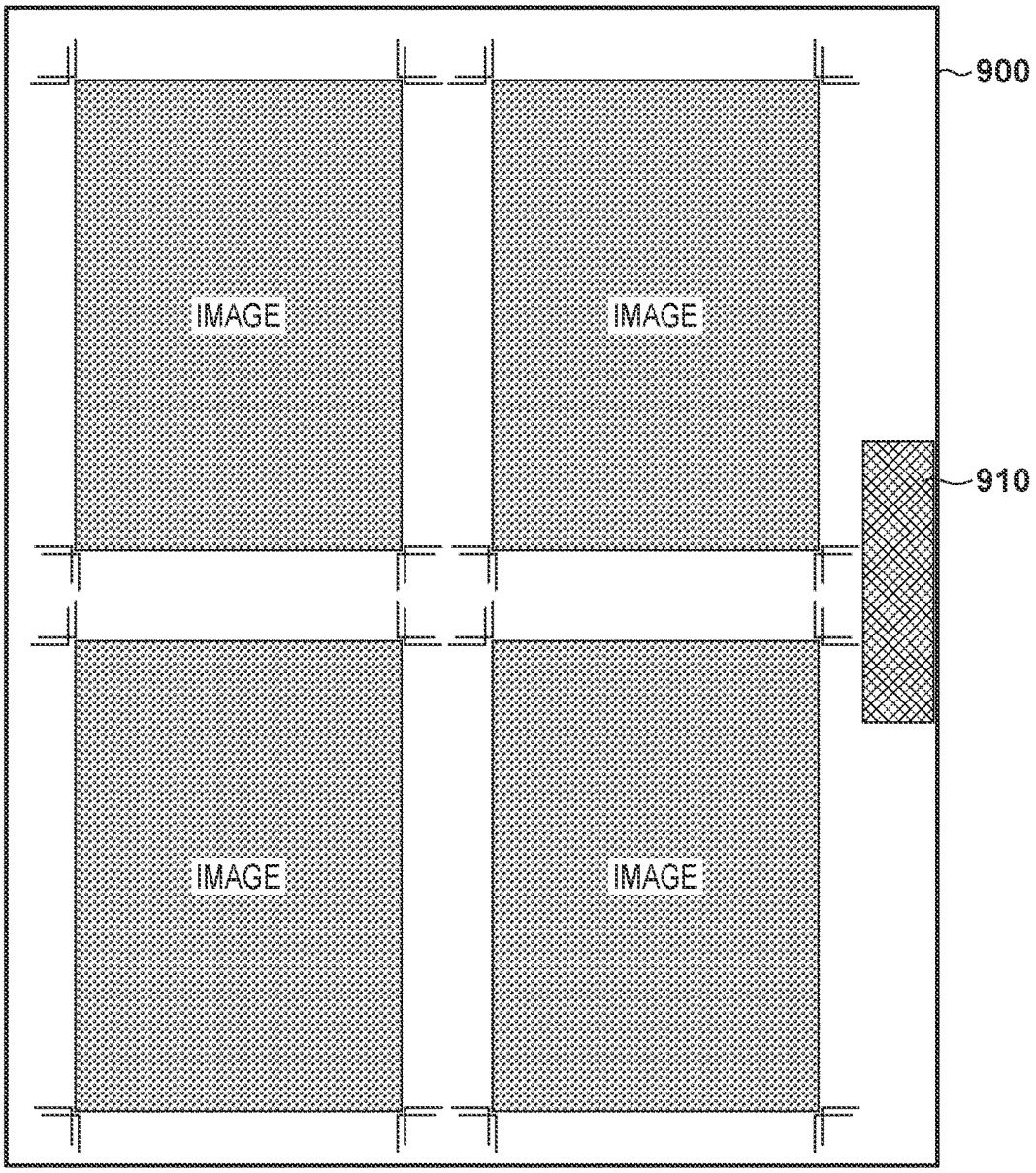
FIG. 9 is a view showing an example of image layout on a sheet.

In the above-described embodiment, an arrangement that forms one user image on one sheet has been described. However, the present invention is not limited to this arrangement, and, for example, a plurality of images may be allocated to one sheet, as shown in FIG. 9. In this case as well, the embodiment can be applied by forming one examination pattern on one sheet.

In the above-described embodiment, the description has been made using an example of the arrangement in which the examination pattern and the user image are in contact. However, a known image such as a pattern or mark used for another examination may be formed. Additionally, in the example shown in FIG. 4, a marginal area is provided between the examination pattern and the edge of the sheet 400. Not the margin but another image such as another pattern may be formed. In any case, it is only necessary that the image included between the edge of the sheet 400 and the examination pattern is known, and the examination pattern area can be specified.

Furthermore, the arrangement of the examination pattern is not limited to those shown in FIGS. 7A to 7D, and may be changed in accordance with the number of colors handled by the recording unit. In addition, the numbers of dots in the conveyance direction and a direction orthogonal to the conveyance direction and the resolution (1,200 dpi in FIGS. 7A to 7D) are not limited to the arrangements shown in FIGS. 7A to 7D.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-049062, filed Mar. 14, 2017, which is hereby incorporated by reference herein in its entirety.

What is claimed is:

1. An image forming apparatus comprising:

a forming unit configured to form an examination pattern at a defined position related to a trailing edge of a recording material;

a detection unit configured to detect that the recording material is conveyed to a predetermined position on a conveyance path;

a reading unit configured to read the examination pattern formed on the recording material, the reading unit being positioned on a downstream side of the forming unit with respect to a conveyance direction;

a memory configured to save image data read by the reading unit, wherein the image data read by the reading unit corresponds to an image of a predetermined period between a start position on a downstream side of the examination pattern and an end position on an upstream side of the trailing edge of the recording material with respect to the conveyance direction;

a specifying unit configured to specify a trailing position corresponding to the trailing edge of the recording material in the image data saved in the memory; and an examining unit configured to examine an examination pattern area corresponding to the examination pattern, wherein the examination pattern area is defined based on the trailing position of the image data specified by the specifying unit.

2. The apparatus according to claim 1, wherein the examination pattern is formed at a position in contact with the trailing edge of the recording material.

3. The apparatus according to claim 1, wherein the examination pattern is formed such that a predetermined area is provided between the examination pattern and the trailing edge of the recording material.

4. The apparatus according to claim 3, wherein the predetermined area is a marginal area in which an image is not formed by the forming unit.

5. The apparatus according to claim 1, wherein the forming unit forms a user image at a position closer to a leading edge of the recording material than the examination pattern.

6. The apparatus according to claim 5, wherein the user image is formed at a position in contact with the examination pattern.

7. The apparatus according to claim 1, wherein a part of an image of the image data read by the reading unit corresponds to an image of the conveyance path read by the reading unit.

8. The apparatus according to claim 1, wherein the forming unit forms the examination pattern for every predetermined number of recording materials conveyed on the conveyance path.

9. The apparatus according to claim 1, wherein the forming unit can form an image in correspondence with a plurality of colors, and the examining unit examines a color difference of the examination pattern with respect to a target color in the examination pattern area.

10. The apparatus according to claim 1, wherein the detection unit is arranged on an upstream side of the forming unit with respect to the conveyance path.

11. A control method of an image forming apparatus including a forming unit configured to form an examination pattern at a defined position related to a trailing edge of a recording material; a detection unit configured to detect that the recording material is conveyed to a predetermined position on a conveyance path; a reading unit configured to read the examination pattern formed on the recording material, the reading unit being positioned on a downstream side of the forming unit with respect to a conveyance direction; and a memory configured to save image data read by the reading unit, the method comprising:

saving the image data read by the reading unit in the memory, wherein the image data read by the reading unit corresponds to an image of a predetermined period between a start position on a downstream side of the examination pattern and an end position on an upstream side of the trailing edge of the recording material with respect to the conveyance direction;

specifying a trailing position corresponding to the trailing edge of the recording material in the image data saved in the memory; and examining an examination pattern area corresponding to the examination pattern, wherein the examination pattern area is defined based on the trailing position of the image data specified in the specifying step.

12. The control method according to claim 11, wherein the examination pattern is formed at a position in contact with the trailing edge of the recording material.

13. The control method according to claim 11, wherein the examination pattern is formed such that a predetermined area is provided between the examination pattern and the trailing edge of the recording material.

14. The control method according to claim 13, wherein the predetermined area is a marginal area in which an image is not formed by the forming unit.

15. The control method according to claim 11, wherein the forming unit forms a user image at a position closer to a leading edge of the recording material than the examination pattern.

16. The control method according to claim 15, wherein the user image is formed at a position in contact with the examination pattern.

17. The control method according to claim 11, wherein a part of an image of the image data read by the reading unit corresponds to an image of the conveyance path read by the reading unit.

18. An examination method for an image forming apparatus, comprising:

acquiring image data obtained by reading an image on a conveyance path when a recording material on which an examination pattern is formed at a defined position related to a trailing edge of the recording material is conveyed, wherein the read image data corresponds to an image of a predetermined period between a start position on a downstream side of the examination pattern and an end position on an upstream side of the trailing edge of the recording material with respect to a conveyance direction;

specifying a trailing position corresponding to the trailing edge of the recording material in the image data; and examining an examination pattern area corresponding to the examination pattern, wherein the examination pattern area is defined based on the trailing position of the image data specified in the specifying step.

* * * * *